US006814127B2

(12) United States Patent
Tagtow et al.

(10) Patent No.: US 6,814,127 B2
(45) Date of Patent: Nov. 9, 2004

(54) RETRACTABLE SCREEN DOOR COMPONENTS AND METHOD

(75) Inventors: Gary E. Tagtow, Pella, IA (US); Dean A. Rennich, Pella, IA (US); Bruce A. Hagemeyer, Pella, IA (US); Ronald L. Spoelstra, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 10/360,554

(22) Filed: Feb. 7, 2003

(65) Prior Publication Data

US 2004/0154753 A1 Aug. 12, 2004

(51) Int. Cl.[7] ..... A47H 1/00
(52) U.S. Cl. ..... 160/31; 160/273.1; 160/315
(58) Field of Search ..... 160/31, 315, 273.1, 160/323.1, 38, 19, 395, 392, 383, 263, 903, 23.1

(56) References Cited

U.S. PATENT DOCUMENTS

| | | | | |
|---|---|---|---|---|
| 1,595,234 | A | | 8/1926 | Kuyper |
| 3,196,935 | A | | 7/1965 | Christensen |
| 3,882,921 | A | | 5/1975 | Sandall |
| 4,221,255 | A | * | 9/1980 | Barkemeyer ..... 160/197 |
| 4,333,511 | A | | 6/1982 | Johnston |
| 4,359,081 | A | | 11/1982 | Brower |
| 4,399,855 | A | * | 8/1983 | Volfson ..... 160/23.1 |
| 4,516,618 | A | | 5/1985 | Gardner et al. |
| 4,651,797 | A | | 3/1987 | Lange |
| 4,658,879 | A | | 4/1987 | Van Klompenburg |
| 4,702,297 | A | | 10/1987 | Van Klompenburg |
| 4,757,852 | A | | 7/1988 | Jentof et al. |
| 4,821,786 | A | | 4/1989 | Johnston |
| 5,092,388 | A | | 3/1992 | Evers |
| 5,392,835 | A | | 2/1995 | Wildt |
| 5,505,244 | A | | 4/1996 | Thumann |
| 5,513,469 | A | | 5/1996 | Tajudeen et al. |
| 5,575,321 | A | | 11/1996 | Currier |
| 5,758,704 | A | | 6/1998 | Elrod |
| 5,934,353 | A | * | 8/1999 | Buhr ..... 160/269 |
| 6,059,007 | A | | 5/2000 | Tomita |
| 6,082,432 | A | | 7/2000 | Kissinger |
| 6,125,908 | A | | 10/2000 | Ament et al. |
| 6,209,610 | B1 | | 4/2001 | Davies et al. |
| 6,422,287 | B1 | | 7/2002 | Wilke |
| 6,435,254 | B1 | | 8/2002 | Todd et al. |
| 6,446,696 | B1 | | 9/2002 | Davies et al. |
| 6,463,983 | B1 | | 10/2002 | Lang |
| 6,540,004 | B2 | | 4/2003 | Wu |
| 2001/0000878 | A1 | | 5/2001 | Davies et al. |
| 2001/0027621 | A1 | | 10/2001 | Davies et al. |
| 2001/0030028 | A1 | | 10/2001 | Poppema |
| 2001/0042346 | A1 | | 11/2001 | Brioschi |
| 2002/0092628 | A1 | | 7/2002 | Todd |
| 2002/0129554 | A1 | | 9/2002 | van Leeuwen |

* cited by examiner

*Primary Examiner*—David Purol
(74) *Attorney, Agent, or Firm*—Faegre & Benson, LLP

(57) ABSTRACT

A retractable flexible screen for installation to a frame of a fenestration product, the frame having opposite pairs of frame members. The flexible screen extending and retracting across an opening in the fenestration product and including flexible screen material and a roller system upon which the screen material is unwound and wound. The roller system mounting to a pair of mounting brackets, each attachable to one of the pairs of frame members. A control bar connects to the screen material and moves along a pair of tracks each mountable to the same pair of frame members, the screen material extending from the roller system to one of the other pair of frame members. A gripper system mounts in the tracks and grips the screen material in a closed flexible screen. A spring tensioning system provides post-installation access to adjust the tension of a spring within the roller system.

40 Claims, 17 Drawing Sheets

RETRACTABLE SCREEN DOOR COMPONENTS AND METHOD

FIELD OF THE INVENTION

This invention relates to retractable flexible screens for doors, such as sliding glass patio doors.

BACKGROUND OF THE INVENTION

Retractable screens for doors and windows have been available for years and many variations are currently on the market. These screens typically include a frame that may be added on to an existing doorway or window, either on the interior or the exterior. The screen material is generally flexible and is wound up about a roller at one side of the opening. The frame usually includes tracks formed from profiled aluminum extrusions along which the screen material is passed during the opening and closing of the screen. Some versions are self-closing, including spring or pulley systems for power, and some are motorized for remote and/or automatic operation.

Although plentiful, the currently available add-on retractable screens are limited in many respects. For example, because the screen is added on to an existing door or window, it must conform to the available door or window frame in order to provide a sealed unit. Adaptation to meet the variances in the existing frame is difficult and may be limited by the provided frame of the screen. In addition, sealing of the flexible screen material relative to the frame, in order to keep out dirt, bugs and other debris, can be difficult, especially at the roller mechanism or on the outer edges. Further, these add-on screens normally are provided in only a limited number of colors that are coated onto the aluminum. Although on the exterior, colored aluminum may conform to storm windows, aluminum siding or other exterior features of the house, on the interior, colored aluminum may be an eye-sore or may not fit in with the interior décor of the house or building.

SUMMARY OF THE INVENTION

The retractable screen door of the present invention provides component features that improve adjustability with respect to the frame for ease on installation and maintenance, better sealing and an aesthetically pleasing look for interior installation. A retractable flexible screen is provided to be installed to a frame of a fenestration product with the frame having first and second pairs of frame members bounding the fenestration product. The flexible screen includes flexible screen material and a roller system upon which the flexible screen material is unwound and wound during extension and retraction, respectively. The roller system extends across a length of the opening from one of the first pair of frame members to an opposite one of the first pair of frame members with the flexible screen material extending toward one of the second pair of frame members as a closing member. A pair of mounting brackets, each attachable to one of the first pair of frame members, are also included. The roller system mounts to the pair of mounting brackets at each end. A control bar is connected to the flexible screen material at a first edge, and first and second tracks are provided, each mountable to one of the first pair of frame members adjacent to the roller between the roller and the closing member toward which the flexible screen material extends. The first and second tracks are each coupled to the control bar at an opposite end, such that the control bar moves back and forth along the first and second tracks from the roller system to the closing member.

A gripper system is optionally provided coupled to the pair of tracks. The gripper system is adapted to hold the flexible screen material securely at the pair of tracks when the flexible screen is extended across the opening in the closed position. The gripper system includes a gripper mechanism and a triggering mechanism, the gripper mechanism configured to grip the flexible screen material against each track upon activation by the triggering mechanism.

A spring tensioning system is also optionally provided external to the roller system for adjusting a spring tension of the roller system. The spring tensioning system is preferably accessible after installation of the flexible screen to the door frame. The spring tensioning system includes an adjustable bracket assembly provided as one of the pair of mounting brackets.

DETAILED DESCRIPTION OF THE INVENTION

Figure 1:
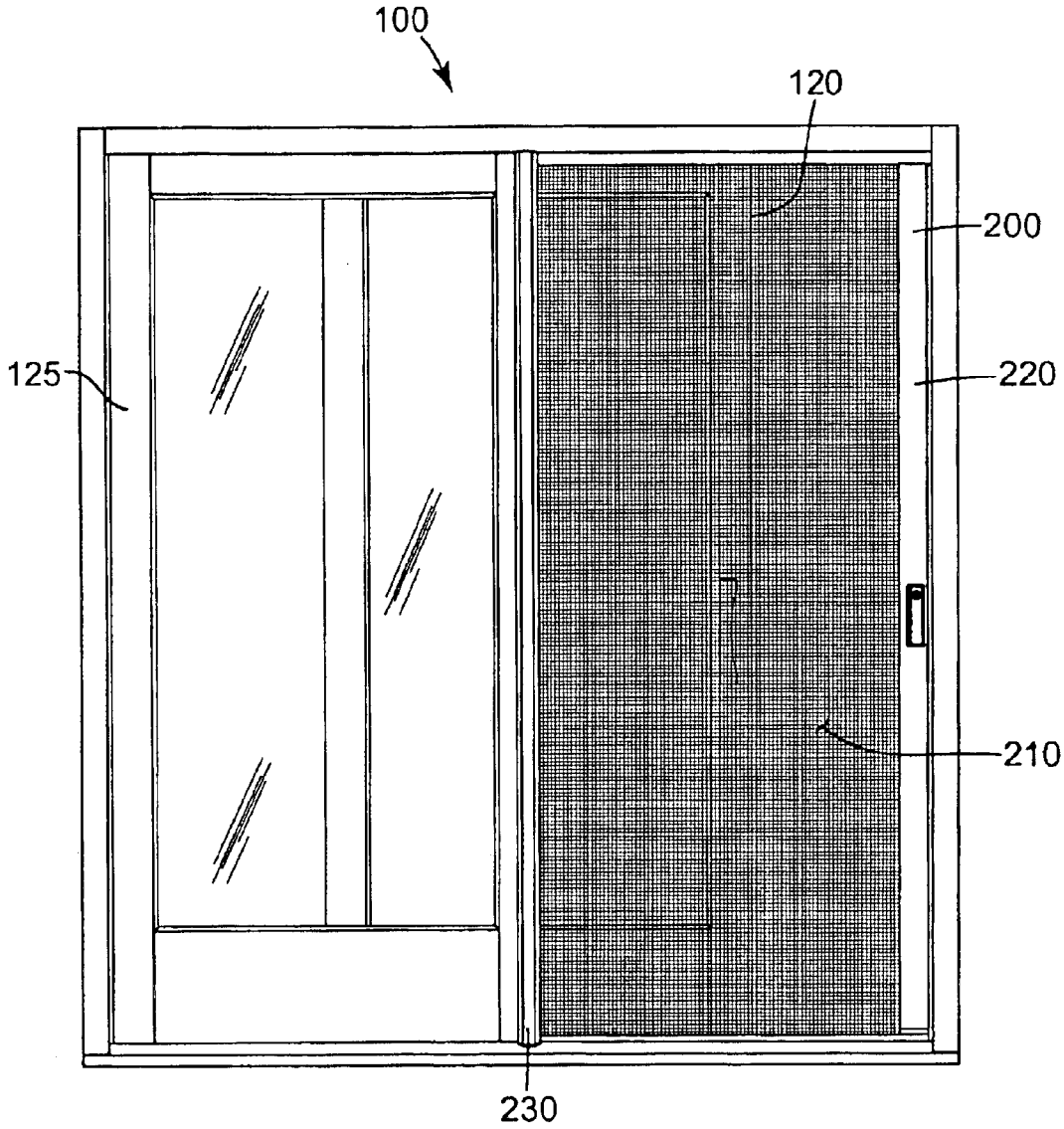
FIG. 1 is a front view of a double door including a flexible screen door in accordance with the present invention.

With reference to the attached Figures, it is to be understood that like components are labeled with like numerals throughout the several Figures. FIG. 1 is a double door 100, such as is commonly used as a patio door, having a sliding door unit 120 and one primarily stationary door unit 125, both surrounded by a frame 102. A flexible screen door 200 in accordance with the present invention is mounted to cover an opening 114 created when the sliding door unit 120 is slid open. Although shown with respect to one door configuration, it is to be understood that the flexible screen of the present invention is applicable to a variety of fenestration products that may be opened and thus require a screen to keep out unwanted insects and debris, including both doors and windows.

Figure 2:
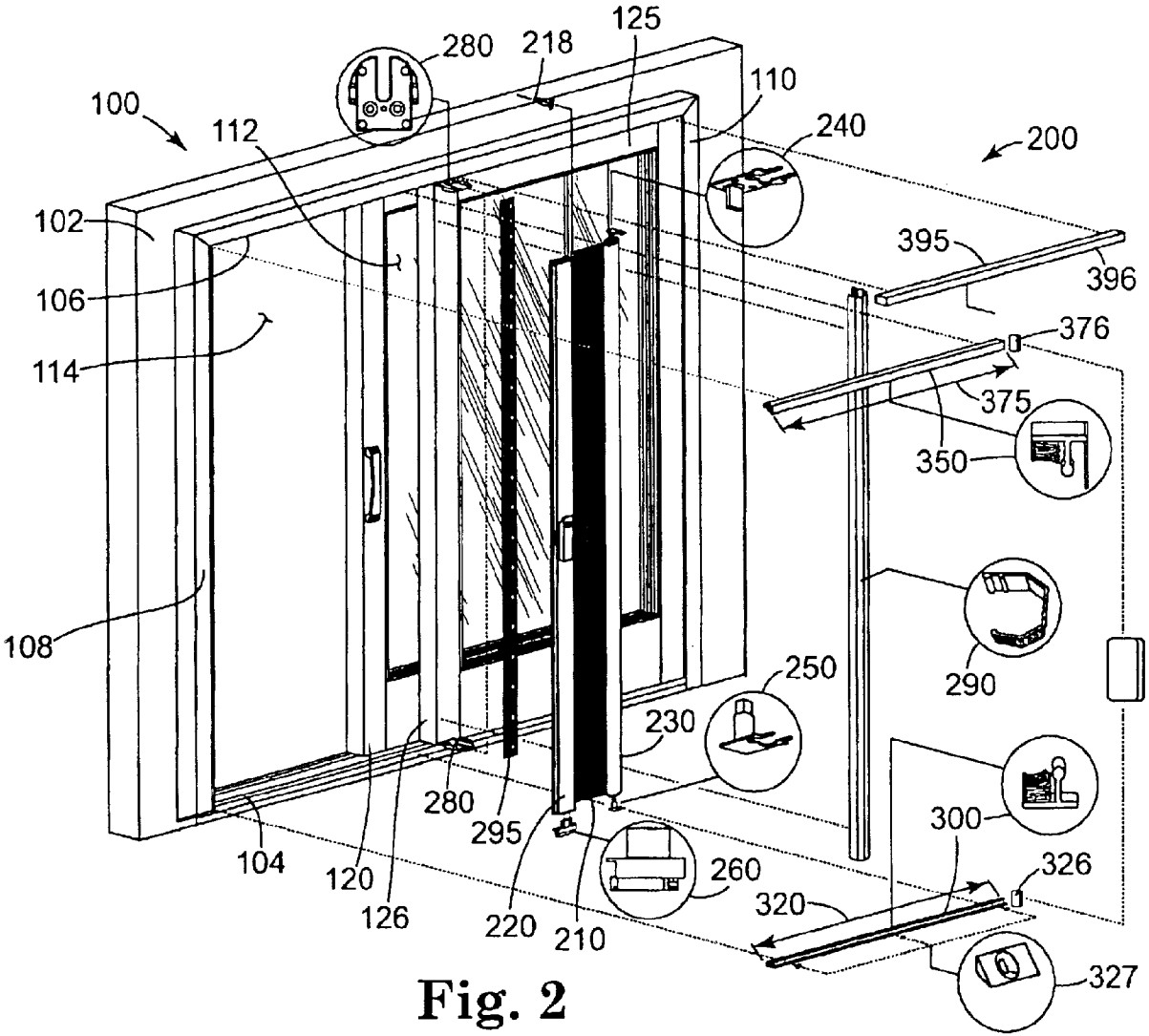
FIG. 2 is an exploded perspective view of the door of FIG. 1 with the screen door to be opened in an opposite direction.

Referring now also to FIG. 2, the components of the flexible screen door 200 are shown in an exploded format, as they would preferably be installed to the door 100. In this embodiment, the flexible screen door 200 is installed about midway along a bottom sill member 104 and a top frame member 106 of the door 100, adjacent a side frame 126 of the primarily stationary door 125. The flexible screen door 200 generally includes a flexible screen material 210 wound up in a covered roller assembly 230 and a control bar 220 for extending the screen material 210 across the opening 114 along bottom and top tracks, 300 and 350, respectively. The flexible screen door 200 is adaptable for installation on both right and left hand opening doors, as shown in FIGS. 1 and 2, respectively.

Figure 3:
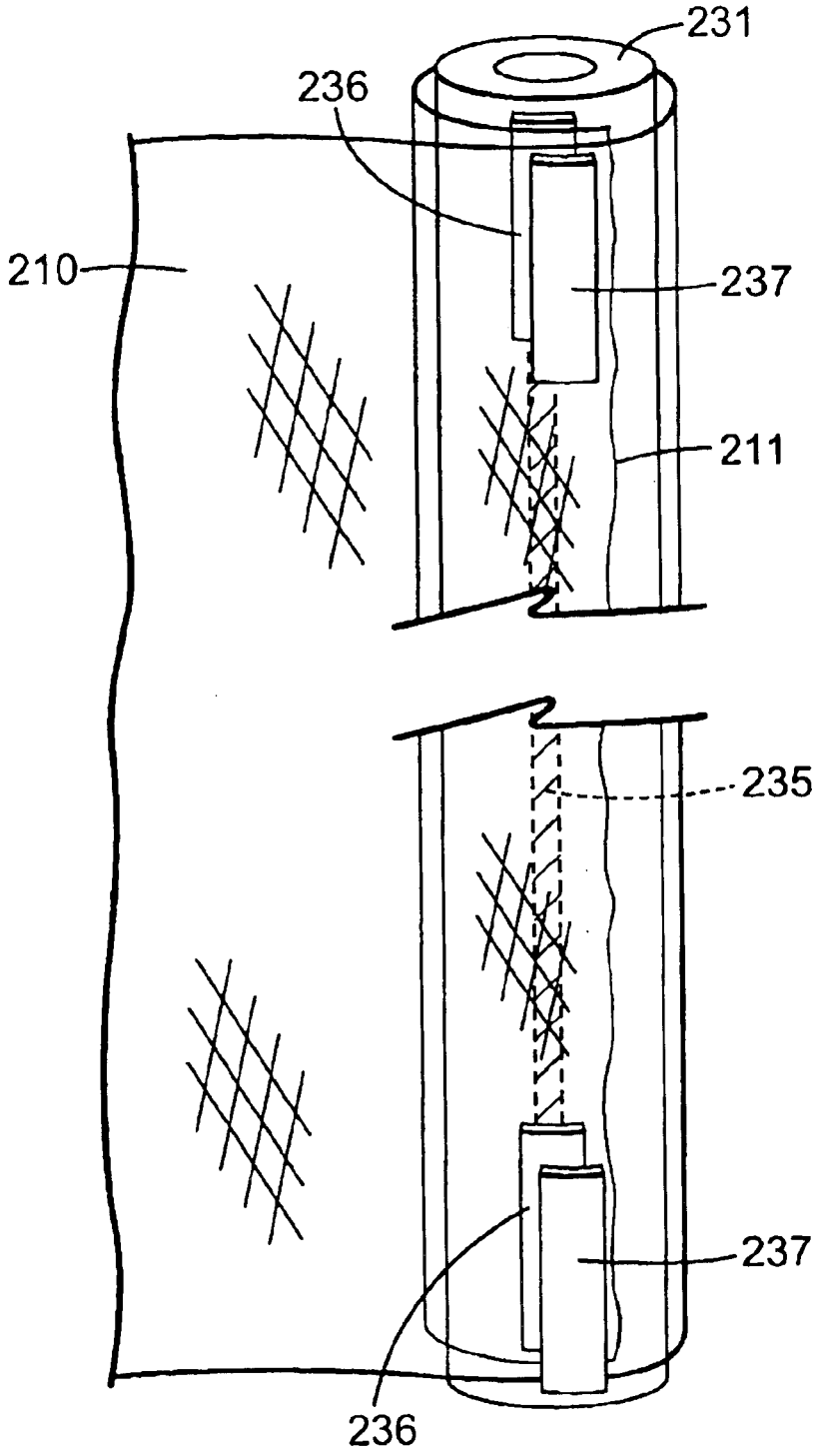
FIG. 3 is a partial exploded view of a roller system and control bar.
Figure 4:
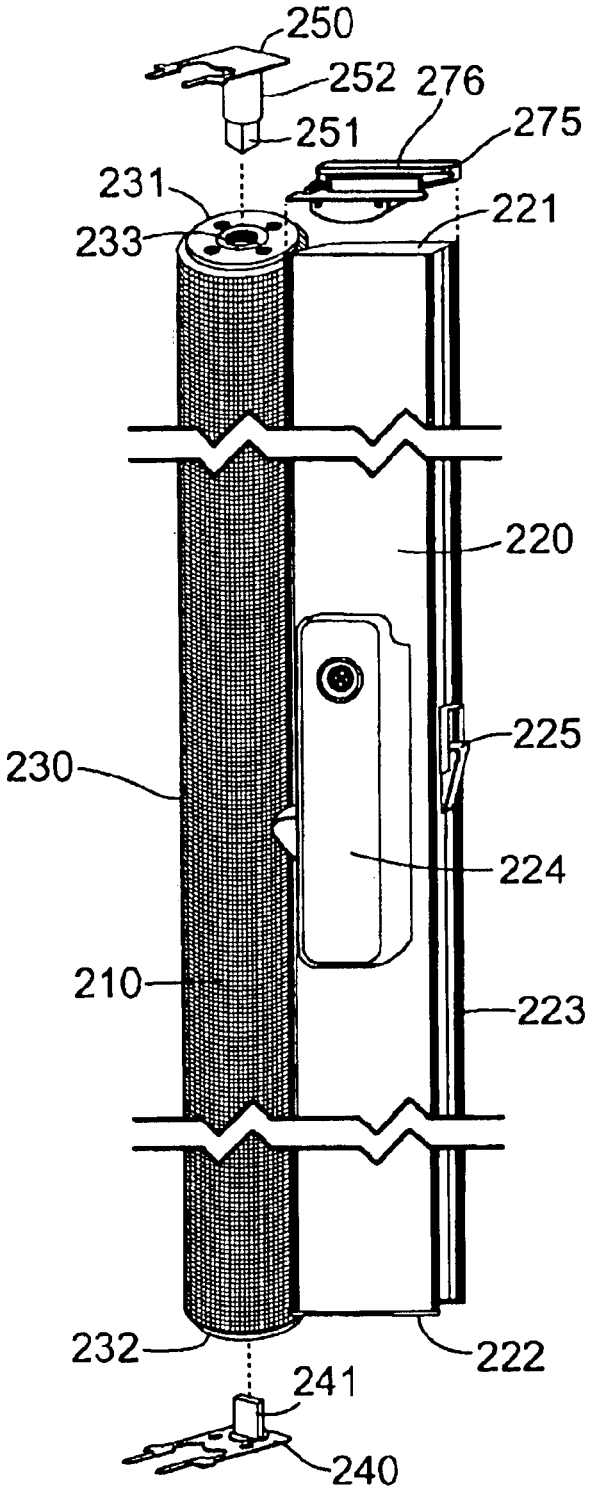
FIG. 4 is a detailed end view of the roller system and control bar of FIG. 3.

The covered roller assembly 230, or roller system, as shown in more detail in FIGS. 3–6, includes a roller 231 about which the flexible screen material 210 is wound. Internal to the roller 231, a spring (not shown) is provided so that the flexible screen material 210 will rewind about the roller. 231 upon closing or release of the flexible screen door 200. A near edge 211 of the screen material 210 is attached to the roller 231, usually by a strip of adhesive 235 provided on the roller 231. In order to increase the strength of the bond between the screen material 210 and the roller 231, a pair of curved bottom strips 236, preferably form from a polymer, such a thin wall PVC tubing, are placed at each end of the roller 231 over the adhesive 235, as shown in FIG. 3. Each bottom strip 236 is preferably about 3 inches in length and about 0.5 inches wide. The near edge 221 of the screen material 210 is then placed over the adhesive 235 and bottom strips 236, and then wrapped one time around the roller 231. A pair of top strips 237, similar to or the same as the bottom strips 236, are then placed over the bottom strips 236 and bonded to the bottom strips 236. In one embodiment, the bottom and top strips, 236, 237, are ultrasonically welded together. This set up insures a strong attachment of the screen material 210 to the roller 231.

Figure 5:
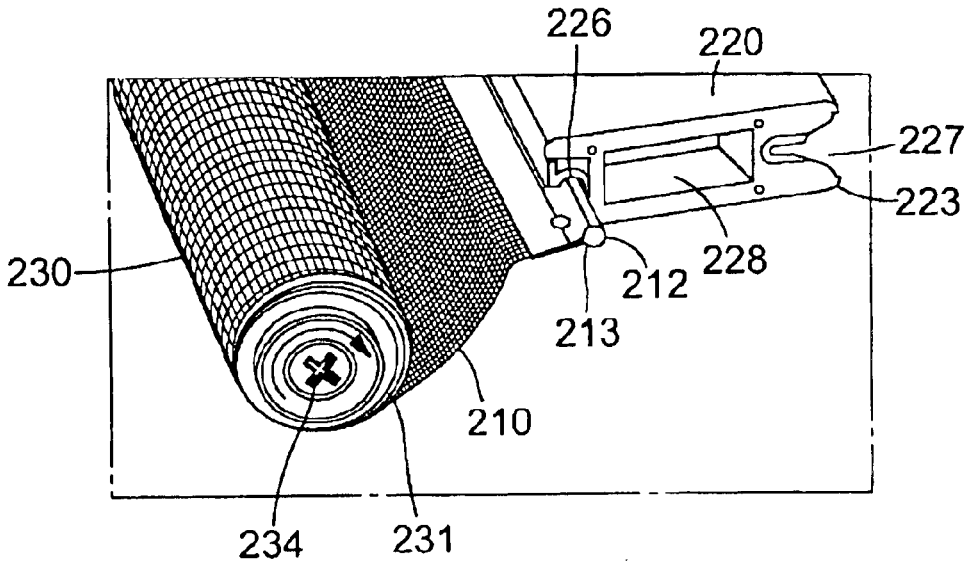
FIG. 5 is a cross-sectional view of a control bar attached to a flexible screen material.
Figure 6:
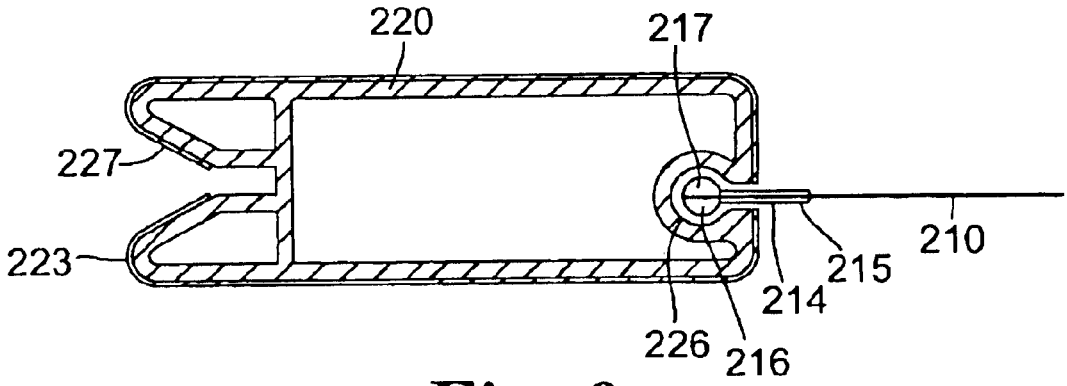
FIG. 6 is a perspective exploded view of a mounting bracket and adapter clip.

The flexible screen material 210 also includes a profiled leading edge 212, such as a strip 213 attached to the edge of the screen material 210. The strip 213 may be provided in one of many configurations, including but not limited to a cylindrical or rod-shaped strip, as shown in FIG. 5. The strip 213 may be attached to the screen material 210 by any suitable method, including but not limited to ultrasonic welding or adhesive. In one embodiment, as shown in FIG. 6, a pair of strips 214 are provided and attached to the flexible screen material 210 on either side of the material 210. Each strip 214 includes a flat region 215 and a half-moon shaped region 216 that form a generally circular end region 217 when placed on either side of the flexible material 210. The pair of strips 214 are ultrasonically welded to the flexible material 210 to form a firm attachment and engagement with the control bar 220.

The control bar 220, also known as a lead stile, is preferably formed as a profiled aluminum extrusion that extends the full height of the flexible screen material 210. A trailing edge includes a receiving portion 226 configured to interface with the profiled leading edge 212 of the flexible screen material 210. As shown, the generally round strip 213 slides into a matingly concave receiving portion 226, so as to connect the flexible screen material 210 to the control bar 220. Other methods of providing a connection between these two components are also possible and within the knowledge of one of ordinary skill in the art. A fastener 218 is used to attach the leading edge 212 to the control bar 220, so that it does not slide out again upon mounting of the roller assembly 230 and so that the flexible screen material 210 does not sag during operation.

The control bar 220 also includes a handle 224 provided with or without a locking mechanism, and a latch mechanism 225 mounted at a leading edge 223 of the control bar 220. The latch mechanism 223 interfaces with a receptacle (not shown) provided on the door frame 102, such as on left side frame 108, so as to hold the flexible screen door 200 open across opening 114. The leading edge 223 of the control bar 220 preferably includes an indentation 227 configured to mate with a screen nosing (not shown) on the door frame 108, so as to form a seal that keeps out bugs and debris. The receptacle and screen nosing usually exist on the door frame 102 as components of a flat screen (not shown) provided with the door 100. The flat screen is removed before installation of the retractable flexible screen door 200 of the present invention, but the mounting structure for the flat screen provided with the door 100 remains available for use with the later added flexible screen door 200.

Figure 7:
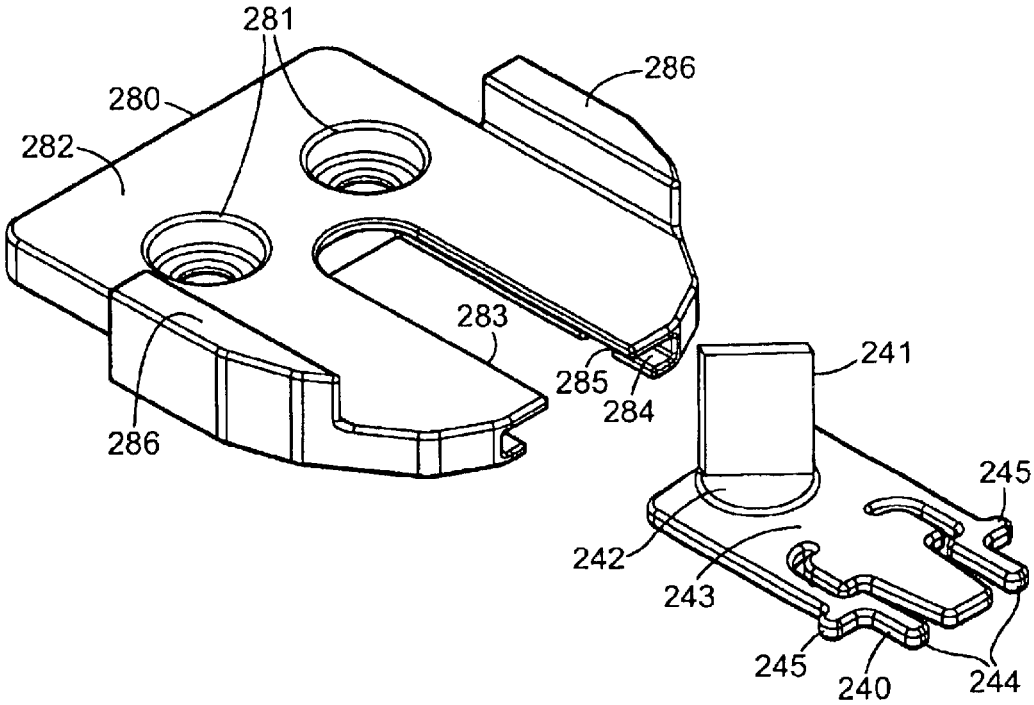
FIG. 7 is an assembled view of a mounting bracket and adapter clip.
Figure 8:
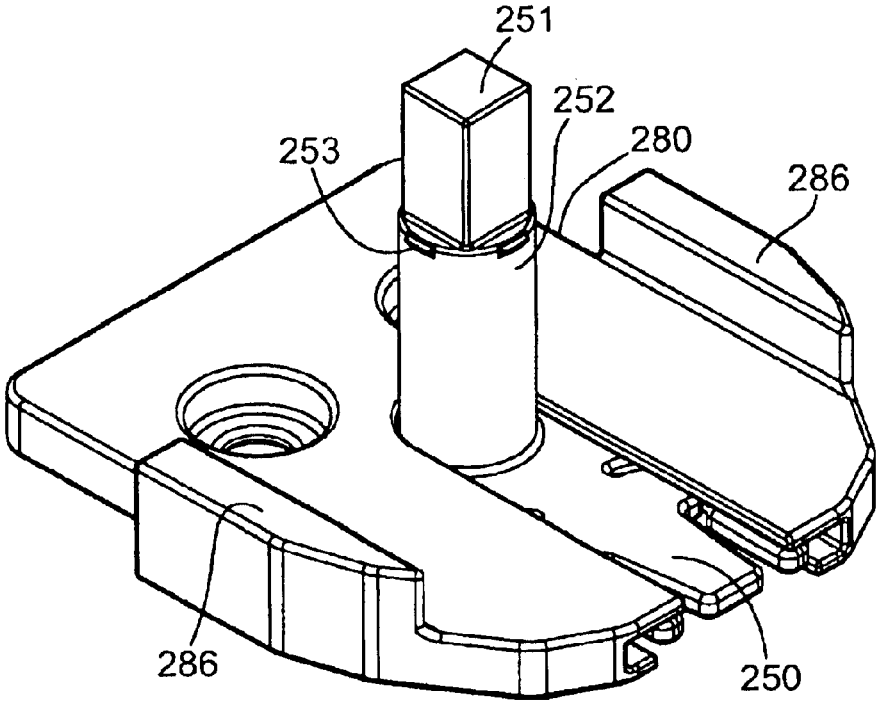
FIG. 8 is a top view of a mounting bracket, cover seal and cover, in accordance with the present invention.
Figure 9:
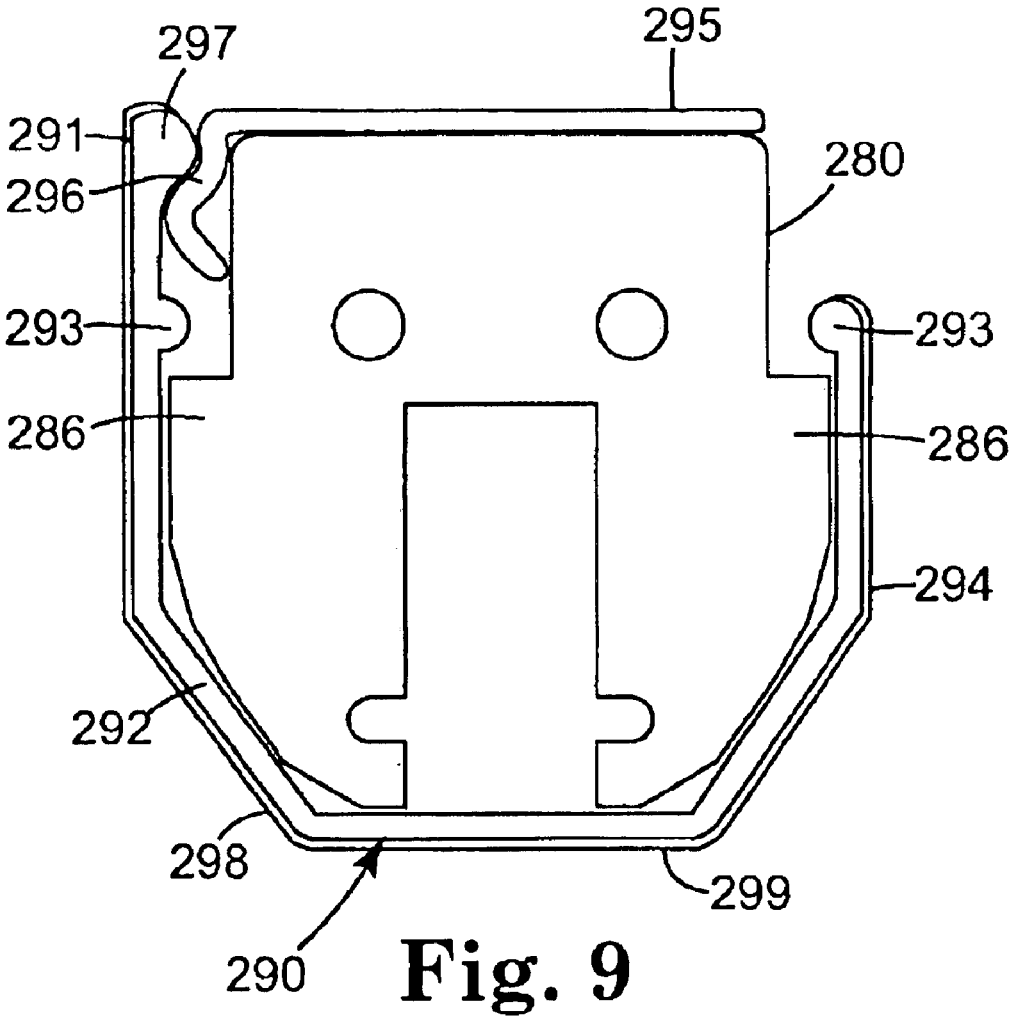
FIG. 9 is a perspective view of an adjustable bracket assembly in accordance with the present invention.

Referring now also to FIGS. 7–9, the roller assembly 230 mounts to the door frame 102 using a pair of brackets 280. One bracket mounts to the underside of the top inner frame member 106 and the other bracket mounts to the topside of the sill frame member 104. As stated above, in this embodiment, these brackets 280 are positioned about midway along a width of the door frame 102 and adjacent the inner side frame 126 of the stationary door 125. Each bracket 280 includes a pair of mounting holes 281 for attachment to the door frame 102.

In order to facilitate ease of assembly, installation and adjustment of the roller assembly 230, the brackets 280 connect to the roller 231 using a spring adapter 240 and a dampening adapter 250. These two adapters 240, 250 are inserted into openings, such as 234, provided at a bottom end 232 and a top end 233 of the roller 231. Once installed onto the roller 231, the adapters 240, 250 are slid in and snapped onto the brackets 280. The location of the adapters 240, 250 with respect to the top and bottom ends 233, 232, respectively, depends on the orientation of the flexible screen door 200 with respect to the door 100, that is right verses left side opening. Referring to FIG. 7, a bracket 280 and spring adapter 240 are shown. The bracket 280 includes the previously mentioned mounting holes 281 formed within a base 282. The base 282 includes a slot 283. Channels 284 are provided in the base 282 along a length of the slot 283 on both sides of the slot 283. Notches 285 are also provided on a bottom side of the channels 284. Preferably, the brackets 280 and adapters 240, 250 are made from a polymer, such as nylon; however, other suitable materials may also be used.

The spring adapter 240 includes a generally rectangular post 241 extending from a cylindrical base 242 formed from or attached to a plate 243. The plate 243 is configured to mate with the channels 284 on the bracket 280, such that the plate 243 slides into and along the channels 284 when the roller assembly 230 is installed onto the brackets 280. The post 241 is sized to ride within slot 283, and the base 282 is configured to position the roller 231 high enough off of the plate 243 so that it clears the base 282 of bracket 280 during installation and removal. The plate 243 includes two fingers 244, each having a protrusion 245 that engages the notches 285 in the bracket 280 upon installation, similar to a bayonet-type connector. The fingers 244 are flexible or resilient enough so that movement of the fingers 244 toward each other causes the protrusions 245 to disengage from the notches 285, thereby facilitating easy removal of the adapter 240 and roller 231 from the bracket 280.

In the spring adapter 240, the rectangular post 241 engages the spring of the roller assembly 230. During installation, an installer adjusts the tension of the spring by engaging the spring at opening 234 and rotating the spring a desired number of turns to pre-set the tension of the spring based on the size of the door 100. Upon insertion of the spring adapter 240 into the opening 234 and placement of the roller assembly 230 into the brackets 280, the spring retains the pre-set tension.

The dampening adapter 250, on the other hand, includes a generally square post 251 mounted on top of a cylindrical base 252. The square post 251 engages a dampener (not shown) positioned within roller 231, so as to dampen rewinding of the flexible screen material 210 about the roller 231. This aids in preventing the control bar 220 from slamming when the flexible screen door 200 is opened and released. The cylindrical base 252 includes four ears 253 evenly spaced about a circumference of the cylindrical base 252. The ears 253 facilitate installation of the dampening adapter 250 within the roller 231 with a press fit, such that the adapter 250 is retained within the roller 231 during placement into the bottom mounting bracket 280 when the adapter 250 is mounted at a bottom end 232. Referring to FIG. 8, the dampening adapter 251 is shown installed into bracket 280.

Referring again to FIG. 2, in order to keep the roller assembly 230 clean during use and non-use, a cover assembly 290 is provided. The cover assembly 290 includes a cover 291 formed as a generally 'U' shaped member having segmented side walls 292. The cover 291 is configured to fit over and attach to the brackets 280, as shown in FIG. 9. Internal knobs 293 are provided on either side of the cover 291 to engage with side members 286 formed on brackets 280 (see also FIGS. 7 and 8). On one side, the side walls 292 extend the full depth of the brackets 280. On the other side, a side wall 294 is shortened to leave the cover 291 open for passage of the flexible screen fabric 210 from the roller 231. The cover 290 is preferably formed as an aluminum extrusion, however, other suitable materials may also be used.

In order to effectively seal the cover 291 about the roller 231, a resilient sealing strip 295 is provided behind the roller 231 extending between the brackets 280. The sealing strip 295 is attached to the stationary door frame 126 using a plurality of fasteners or other methods. The sealing strip 295 includes a contoured lip 296 on a side opposite the opening in the cover 291. The lip 296 engages a protrusion 297 on the side wall 292 of the cover 291, thereby effectively surrounding the roller assembly 230 and protecting it from debris and damage. In addition to providing a seal and cover connection, the sealing strip 295 serves to lessen vibration in the roller assembly 230 during retraction or rewinding of the flexible screen material 210 about the roller 231. This also lessons the stress upon the roller assembly 230, as well as lessening the noise involved with the operation. The sealing strip 295 is preferably formed from a polymer; however, other suitable materials may also be used.

The cover 291 is preferably provided with a thin layer of decoratable material, such as a veneer 298, attached to an outer surface 299 of the cover 291. The veneer layer 298 is exposed to the interior of the room or facility in which the door 100 is provided. By providing the cover 291 with the veneer layer 298, the flexible screen door 200 mounted to the door 100 may blend in better and otherwise be more aesthetically pleasing within the décor of the room. The veneer layer 298 may be stained, painted, covered with wall paper or otherwise decorated to accommodate the decorating requirements of the room, or to blend in more fully with the door frame 102.

Figure 10:
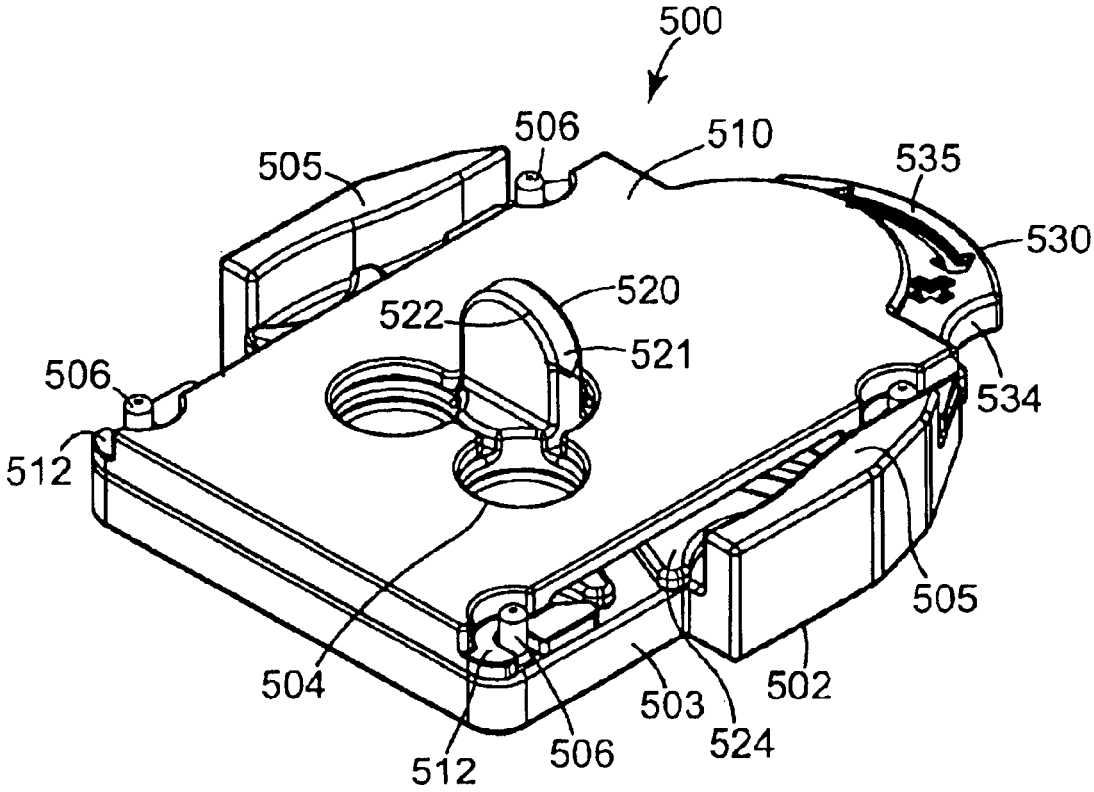
FIG. 10 is an exploded view of the adjustable bracket assembly of FIG. 9.
Figure 11:
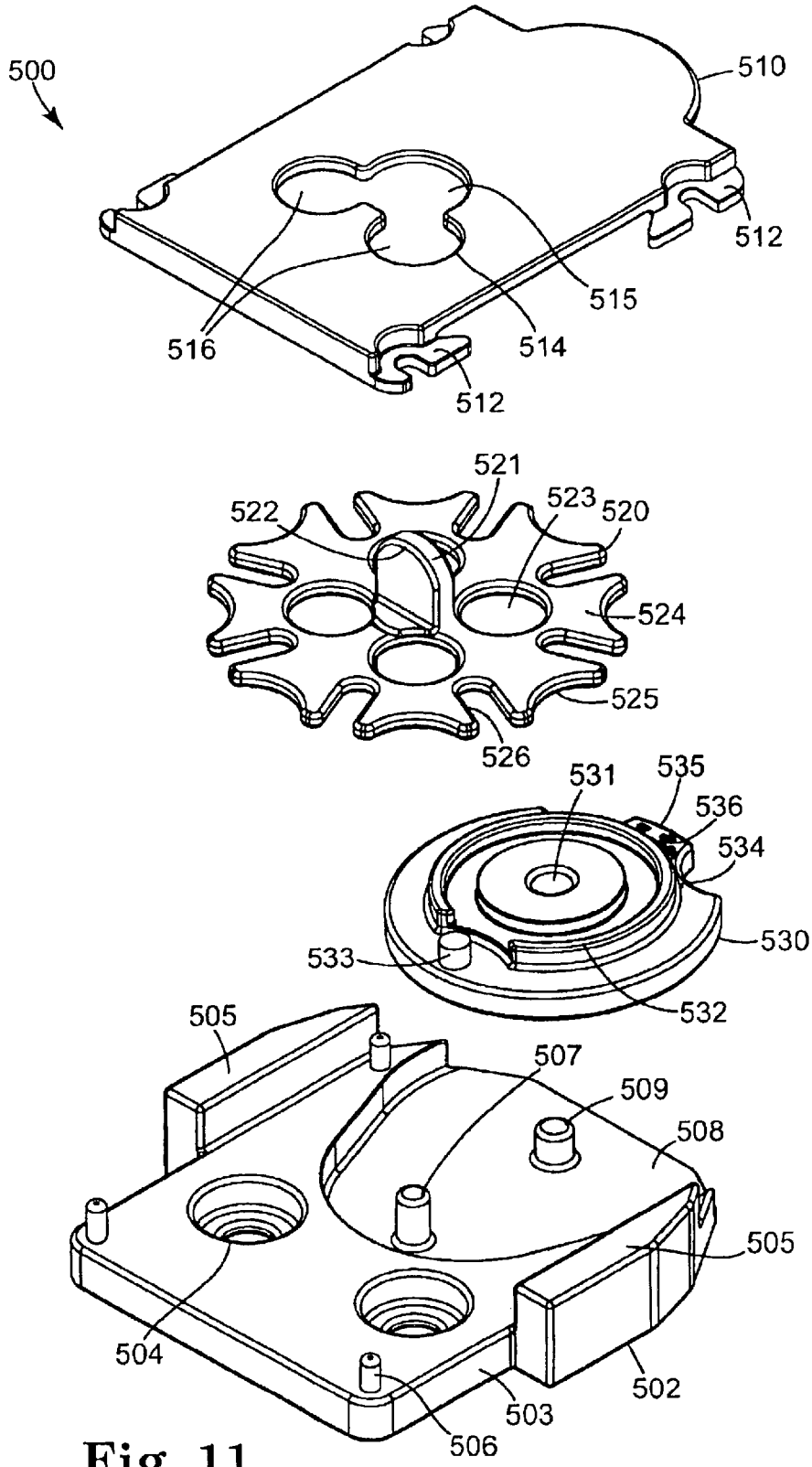
FIG. 11 is a partially assembled view of the adjustable bracket assembly of FIGS. 9 and 10.

On occasion, the tension in the roller spring changes or proves to be incorrect for proper operation of the flexible screen door 200. The roller assembly 230 must then be removed from the brackets 280 and the spring tension adjusted using the method described above. In an alternative embodiment, in order to improve the ease of spring tension re-adjustment without removal of the roller assembly 230, a spring tensioning system is provided. The spring tensioning system is configured as an adjustable bracket assembly 500, which serves as a replacement for one of the brackets 280, as shown in FIGS. 10 and 11. Access to the spring tensioning system is available by removal of the cover 290, which snaps over the adjustable bracket assembly 500 and the other mounting bracket 280, as described above.

The adjustable bracket assembly 500 includes a bracket 502 having a base 503, similar in size and shape to bracket 280. The base 203 includes mounting holes 504 for attachment to the door frame 102 and side members 505 for attachment to the cover 290. In this embodiment, the bracket 502 also includes a cover 510 attached to the base 502 at mounting posts 506. The cover 510 includes notched tabs 512 at each corner for engagement with the mounting posts 506. The cover 510 may then be welded or otherwise attached to the base 503 after completion of the adjustable bracket assembly 500. The cover 510 further includes a lobed aperture 514 having a center hole 515, and two conjoined ear openings 516 that align over the mounting holes 504 when the cover 510 is attached to the base 503. The base 503 further includes a recessed area 507 starting at a center of the base 503 and spreading outward toward a front edge 501. A center post 507 extends upward from the recessed area 508 and a shorter adjustment post 509 is centered within the recessed area 508 near the front edge 501.

A spring connector 520 fits over the center post 507 and rests upon the base 503. The connector 520 includes a generally rectangular post 521 having a radiused upper surface 522, which is centered within the connector 520 and sits over the center post 507 allowing for rotation of the connector 520 about the center post 507 at the rectangular post 521. Four openings 523 symmetrically surround the post 521, such that two of the openings 532 are aligned over the mounting holes 504 at quarter turn rotations of the connector 520. The periphery of the connector 520 is formed into a plurality of lobes 524, each having a concave end surface 525 and separated from an adjacent lobe 524 by a slot 526. In this embodiment, the connector 520 includes eight lobes 524.

The adjustable bracket assembly 500 also includes a thumb wheel 530 mounted over the adjustment post 509 on the recessed area 508 of the bracket base 503. The thumb wheel 530 includes a center hole 531 partially surrounded by a generally 'C' shaped raised collar 532, into which the adjustment post 509 is inserted. The thumb wheel 530 is then rotatable about the adjustment post 509 at the center hole 531. A drive post 533 extending upward toward the adjustment spring connector 520 and cover 510 is provided, positioned across from an opening in the collar 532. Preferably, the drive post 533 is formed as a steel insert or other suitable part having the strength, reliability and wear resistance required by the adjustable bracket assembly 500. A plurality of finger indentations 534 are formed in the periphery of the thumb wheel 530 in one pair or two pairs positioned on either side of the center hole 531. An elongated region 535 is located between the pair of finger indentations 534 with directional indicia 536 provided on the elongated regions 535.

During assembly of the adjustable bracket assembly 500, the thumb wheel 530 is placed onto the base 503 with the adjustment spring connector 520 placed over both. The cover 510 is then positioned overall with the rectangular post 521 protruding through the center aperture 515. The elongated region 535 and a couple of finger indentations 534 of the thumb wheel 530 extend off the front edge 501 of the base 503. Optionally, a wave spring (not shown) may be inserted over the center hole 531 within the raised collar 532 such that it is compressed when the cover 510 is attached. The wave spring would then help to keep the thumb wheel 530 in place and to reduce friction between the parts.

Operation of the adjustable bracket assembly 500 includes mounting of the roller 231 onto the protruding rectangular post 521. When tension adjustment of the roller spring is required, a user turns the thumb wheel 530 at the finger indentations 534 in a desired positive or negative direction (as indicated by the directional indicia 536). Rotation of the thumb wheel 530 causes the drive post 533 to enter into a slot 526 and engage the connector 520. Continued rotation of the thumb wheel 530 results in rotation of the connector 520 driven by movement of the drive post 533. Rotation of the connector 520 causes rotation of the rectangular post 521 within the roller 531 resulting in an increase or decrease of the spring tension. No disassembly of any parts or removal of the roller system 230 is required to achieve a desired adjustment of the spring tension, aside from removal of the cover 290.

Referring again to FIG. 2, the flexible screen door 200 is opened by moving the control bar 220 away from the roller assembly 230, thereby unwinding the flexible screen material 210 and extending it across the door opening 114. In order to provide smooth, non-binding movement of the control bar 220, a bottom track 300 and a top track 350 are installed to the door sill 104 and top frame 106, respectively. Both the bottom and top tracks 300, 350 are preferably formed as aluminum extrusions that have been powder coated to reduce friction. The bottom track 300 is shown attached using screw guides 327, which facilitate ease of installation, accurate angling of the screws and a better appearance.

Figure 12:
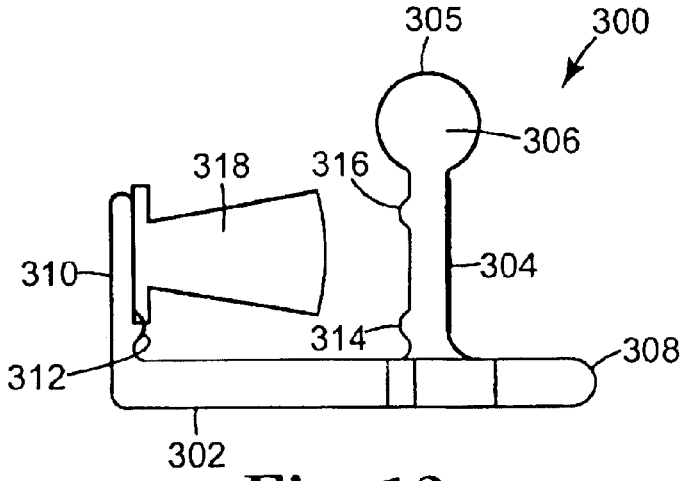
FIG. 12 is an end view of a bottom track.

Referring now also to FIG. 12, the end view of the bottom track 300 is shown, including a base 302, an upright 304 extending from the base 302, and a back wall 310 also extending from the base 302 generally parallel to the upright 304. The upright 304 has a knob 305 formed at an upper end, which provides a rail 306 extending along a length 320 of the bottom track 300 having a generally circular cross-section. The base 302 extends a toe 308 outward away from the back wall 310 beyond the upright 304. A plurality of protrusions 312, 314 and 316 formed on an interior side of the back wall 310 and upright 304 provide ridges extending along the length 320 of the bottom track 300. A strip of mohair 318 or other conformable material is applied to the back wall 310 facing toward the upright 304.

Figure 13:
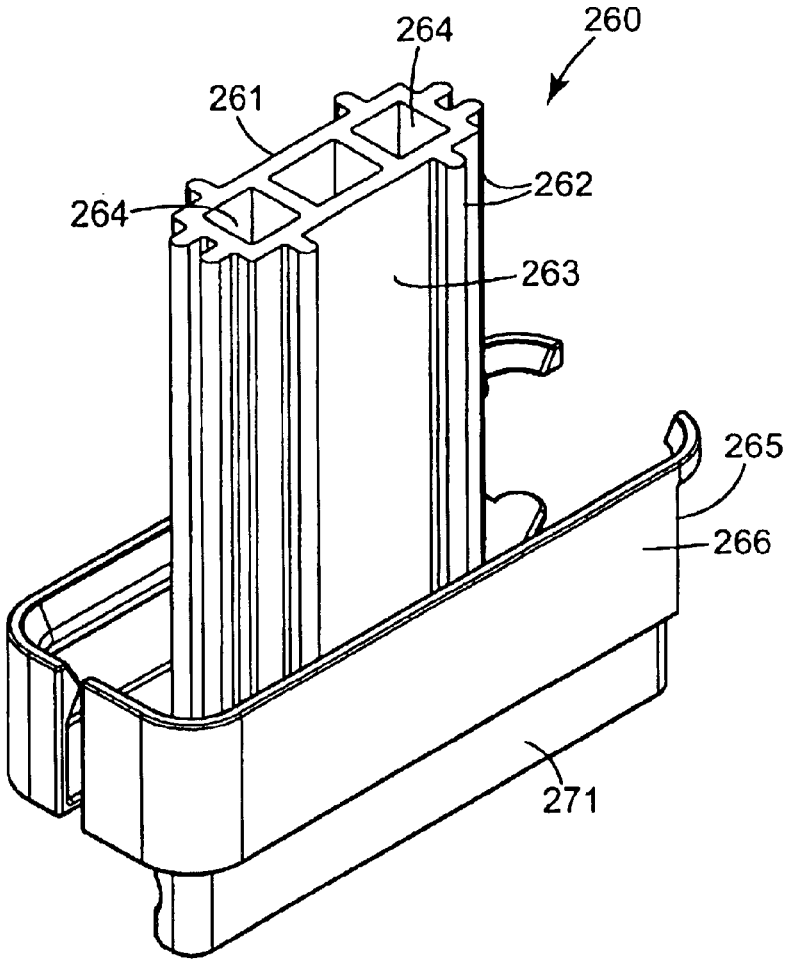
FIG. 13 is a perspective view of a sill plug assembly usable with the bottom track of FIG. 12.
Figure 14:
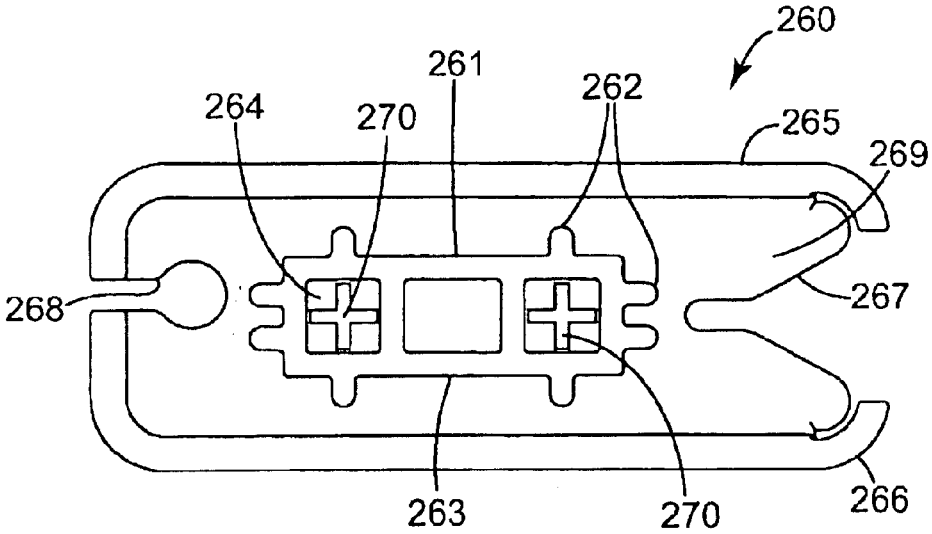
FIG. 14 is a top view of the sill plug assembly of FIG. 13.
Figure 15:
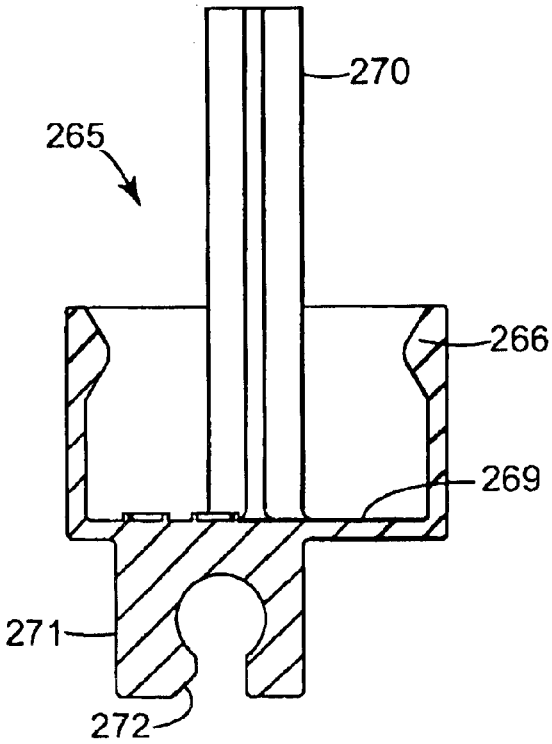
FIG. 15 is a cross-sectional view of the sill plug of FIGS. 13 and 14.

As shown in FIG. 5, the lower end of the control bar 220 includes an opening 228. A sill plug assembly 260 is removably inserted into this opening 228 so as to extend downward from the control bar 220. Referring also to FIGS. 13–15, the sill plug assembly 260 includes a spacer 261 formed with a plurality of projections 262 extending from a surface 263 along a length of the spacer 261. At least a pair of generally square holes 264 are formed within the spacer 261 extending through the length of the spacer 261. The exterior surface 263 of the spacer 261, including the projections 262 are sized to fit within the opening 228 of the control bar 220. As a result, the spacer 261 and control bar 220 may move axially (in this embodiment, vertically) with respect to each other, but will not torque, twist or otherwise move in another degree of freedom.

A sill plug 265 includes a pair of posts 270 formed in a cross or "plus" shape and sized to fit within the square holes 264 of the spacer 261. The spacer 261, thus slides over the posts 270 and allows for axial movement of the spacer 261 with respect to the sill plug 265 without providing for movement in any other degree of freedom. The sill plug 265 also includes a base 269 upon which the posts 270 are formed or mounted and a side wall 266 extending away from the base 269 toward the posts 270, thus forming an enclosure into which the control bar 220 is slidingly received when the spacer is inserted into the control bar opening 228. The side wall 266 and base 269 include an opening configured to correspond with indentation 227 on control bar 220. On an opposite end of the sill plug 265, the side wall 266 and base 269 includes another opening configured to correspond with receiving portion 226 on the control bar 220. Therefore, the sill plug 265 accommodates the requirements of the control bar 220 relative to the door frame 108 and flexible screen material 210.

On a side of the base 269 away from the posts 270, the sill plug 265 includes a rail block 271 having a contoured channel 272 configured to ride along and mate with the rail 306 of the bottom track 300. As a result, the sill plug assembly 260 slideably connects the control bar 220 to the bottom track 300 while allowing for axial variation by providing for axial movement between the control bar 220, spacer 261 and sill plug 265. The sill plug assembly 260 is preferably formed from silicone and Teflon impregnated acetal in order to reduce friction; however, other suitable materials may also be used.

Figure 16:
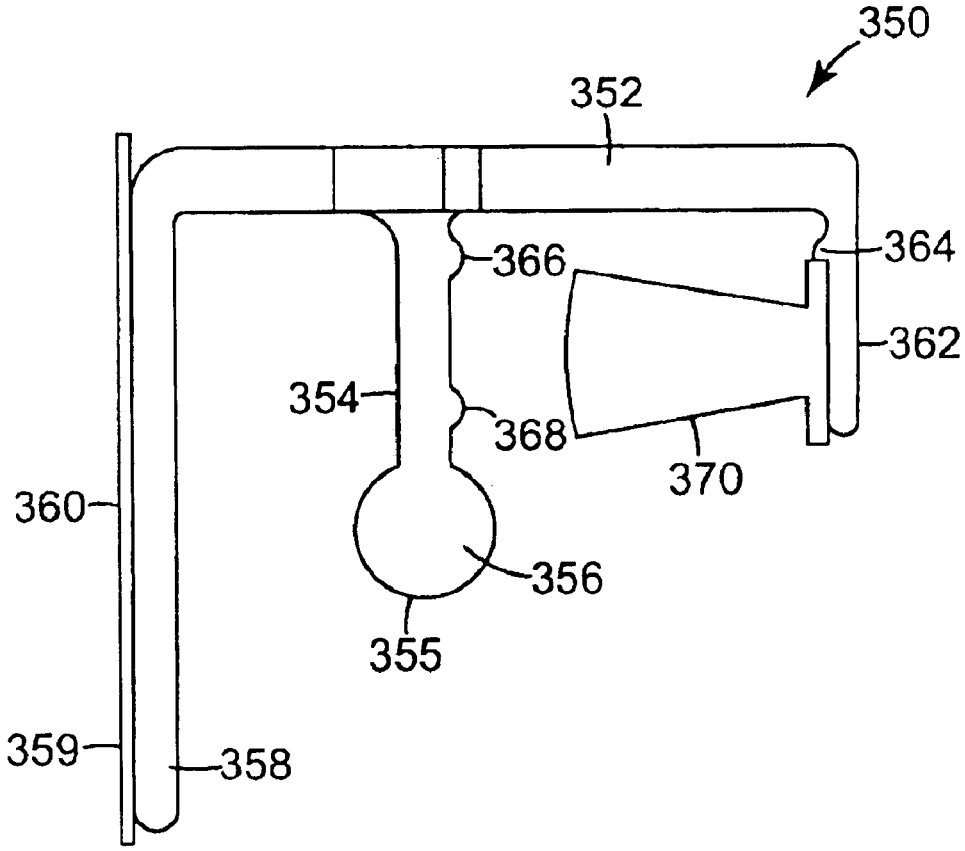
FIG. 16 is an end view of a top track.
Figure 17:
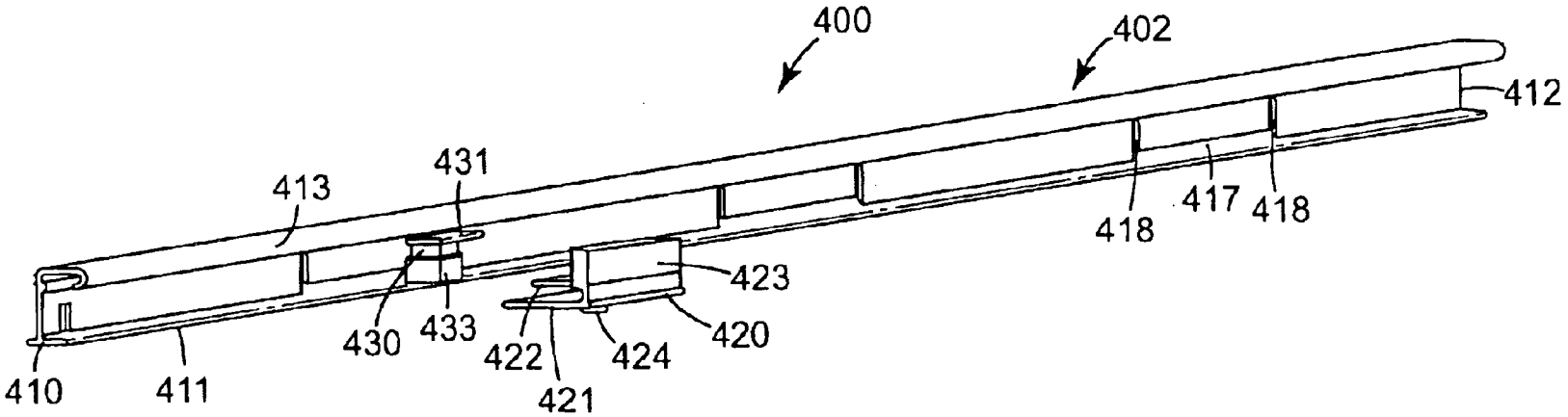
FIG. 17 is an exploded perspective view of a gripper mechanism usable with either a top or bottom track.

Referring now to FIG. 16, an end view of the top track 350 is shown including a base 352, an upright 354 extending from the base 352 and a back wall 362 also extending from the base 352 generally parallel to the upright 354. The upright 354 has a knob 355 formed at an end, which provides a rail 356 extending along a majority of a length 375 of the top track 350 having a generally circular cross-section. Instead of a toe, as in the bottom track 300, the top track 350 includes a front wall 358 also extending from the base 352 generally parallel to the upright 354. A plurality of protrusions 364, 366 and 368 formed on an interior side of the back wall 362 and upright 354 provide ridges extending along the length 375 of the top track 350. A strip of mohair 370 or other conformable material is applied to the back wall 362 facing toward the upright 354.

The front wall 358 extends beyond the height of either the rail 356 or the back wall 362, thereby blocking both from view when the top track 350 is installed to the door top frame 106. In order to conform to the desired décor and be consistent with the cover assembly 290, a layer of veneer 360 is applied to the exterior surface 359 of the front wall 358. This veneer layer 360 may also be stained, painted or otherwise decorated in a manner similar to or the same as the cover veneer layer 298.

The top track 350 is installed in an opposite orientation than the bottom track 300, such that the rail 356 extends downward toward the bottom track 300 and the control bar 220. A top member 275, or head plug, attached to a top end 221 of control bar 220 is formed as a rail block having a contoured channel 276 configured to mate with and ride along rail 356 of top track 350. The control bar 220 is basically suspended from the top track rail 356 without any axial variation or adjustability. The top track 350 serves primarily as a slideable guide for the top of the control bar 220 as it opens or closes the flexible screen door 200. The top member 275 is also preferably formed from silicone and Teflon impregnated acetal; however, other suitable materials may also be used.

In order to balance the top track 350 on the top frame member 106 in appearance, a filler member 395 may be installed on the other side of the roller assembly 230. This filler member 395 also includes a veneer outer layer 396 to be decorated in accordance with the other components. In addition, bottom and top bumper pads, 326 and 376, respectively, formed from resilient material may be installed at the roller assembly end of the bottom and top tracks, respectively. These bumper pads 326, 376 serve as cushions and sound absorbers for the control bar 220 when it opens quickly and/or with force.

As described above, opening of the flexible screen door 200, as shown in FIG. 1, results in the flexible screen material 210 being extended across the door opening 114. As the control bar 220 moves along the bottom and top tracks 300, 350, the screen material 210 passes between the uprights 314, 354 and the mohair 318, 370. The mohair 318, 370 interfaces with the screen material 210 to help keep out bugs and debris. The screen material 210 is preferably kept taught when the flexible screen door 200 is open so that the screen material 210 is held against the mohair 318, 370 for better protection.

In an alternative embodiment, a gripping system 400 is provided along the bottom and top tracks 300, 350 to hold the screen material 210 more firmly in place and provide better protection at these top and bottom edges of the screen door 200. The gripping system 400 is substantially the same for both the bottom and top tracks 300, 350, so only the bottom track 350 will be discussed. Referring now to FIGS. 17–20, the gripping system 400 for the bottom track 300 is shown to include a gripping mechanism 402 having a gripper bar 410 moveably mounted within the bottom track 300 between the back wall 310 and the upright rail 306. A trigger mechanism 450, shown in FIG. 20, which couples to the control bar 220, activates the gripping mechanism 402 to move the gripper bar 410 from the back wall 310 toward the rail 306 so as to pin the flexible screen material 210 between the gripper bar 410 and the rail 306.

The gripper bar 410 is configured as a generally 'C' shaped channel having a foot 411 connected by a back wall 412 to a top 413. An outer edge 414 of the top 413 curves under, that is downward toward the foot 411 and then back toward the back wall 412, forming a narrow channel 415 under the top 413. A ridge 416 is provided on the back wall 412 near the top 413 to more clearly define the channel 415. The back wall 412 includes a plurality of slots 417 formed above the foot 411. Each slot 417 is bounded by a pair of holes 418 through the back wall 412 under the ridge 416.

The gripper bar 410 is inset within the bottom track 300 and moveably held in place by a plurality of clips 420 positioned along the length 320 of the bottom track 300 at each slot 417. Each clip 420 is attached to the bottom track 300 at a stand off 424, which snaps into a hole (not shown) in the bottom track 300. The clip 420 includes a base 421 to which the stand off 424 is attached or formed. A leg 422 that is generally parallel to the base 421 is formed on a side of the base 421 opposite the stand off 424 and is spaced apart from the base 421, such that a channel 425 is provided between the leg 422 and base 421. A block 423 is positioned upon the leg 422 and is configured with a generally oblong shape having radiused inner comers or a generally curved inner surface. The foot 411 of the gripper bar 410 sits upon the base 421 with the leg 422 passing through the slot 417, thereby holding the gripper bar 410 within the bottom track 300. Each slot 417 is longer than each leg 422, thus allowing for sliding movement of the gripper bar 410 in the longitudinal direction.

A plurality of wedges 430 corresponding to the clips 420 are each removably attached to the gripper bar 410 using one of the holes 418 at the ends of each slot 417. The side of the clip 420 at which the wedge 430 is positioned is determined by the direction of travel of the flexible screen door 200. Each wedge 430 includes a shelf 431 offset from a base block 433 by a connecting member 432. The shelf 431 is configured to fit within the channel 415 on the gripper bar 410. The connecting member 432 is sized and positioned to be adjacent to the ridge 416 when the wedge 430 is attached to the gripper bar 410. The base block 533 is configured with a curved outer surface facing the inner surface of the clip block 423. A standoff 434 formed on or attached to the base block 433 is inserted into the hole 418 to mount the wedge 430 to the gripper bar 410.

The trigger mechanism 450 includes an activator bar 460 couplable to either the sill plug 260 or control bar top member 275. The activator bar 460 includes a generally flat bar 461 having a toe 462 at a far end 463 which is angled with respect to the bar 461. Preferably, the toe 462 is about perpendicular to bar 461. At a near end 464, the flat bar 461 includes an offset portion 465 that may be formed by bending bar 461 or by attachment to the bar 461. The offset portion 465 includes an opening 466. The activator bar 460 engages either the sill plug 260 or control bar top member 275 at the toe 462 during closing of the flexible screen door 200 and activation of the gripper system 400.

The activator bar 460 connects to the gripper bar 410 using an activator plug 470 that attaches to the gripper bar 410. The activator plug 470 includes a top portion 471, configured to fit within channel 415 in gripper bar 410, and a side wall 472, configured to mate with an inner surface of back wall 412. The activator plug 470 is attached to the gripper bar 410 using a suitable method, such as side wall locking clips 473 attaching to back wall openings 419. At a near end 474, a portion of the side wall 472 is removed leaving a cantilevered portion 475 and a post 476 having a foot 477. The activator plug 470 connects to the activator bar 460 by the post 476 passing through opening 466, such that the offset portion 465 is positioned between the top portion 471 and foot 477 of the post 476. The activator plug 470 engages either the sill plug 260 or control bar top member 275 at the cantilevered portion 475 during opening of the flexible screen door 200 and de-activation of the gripper system 400.

Figure 18:
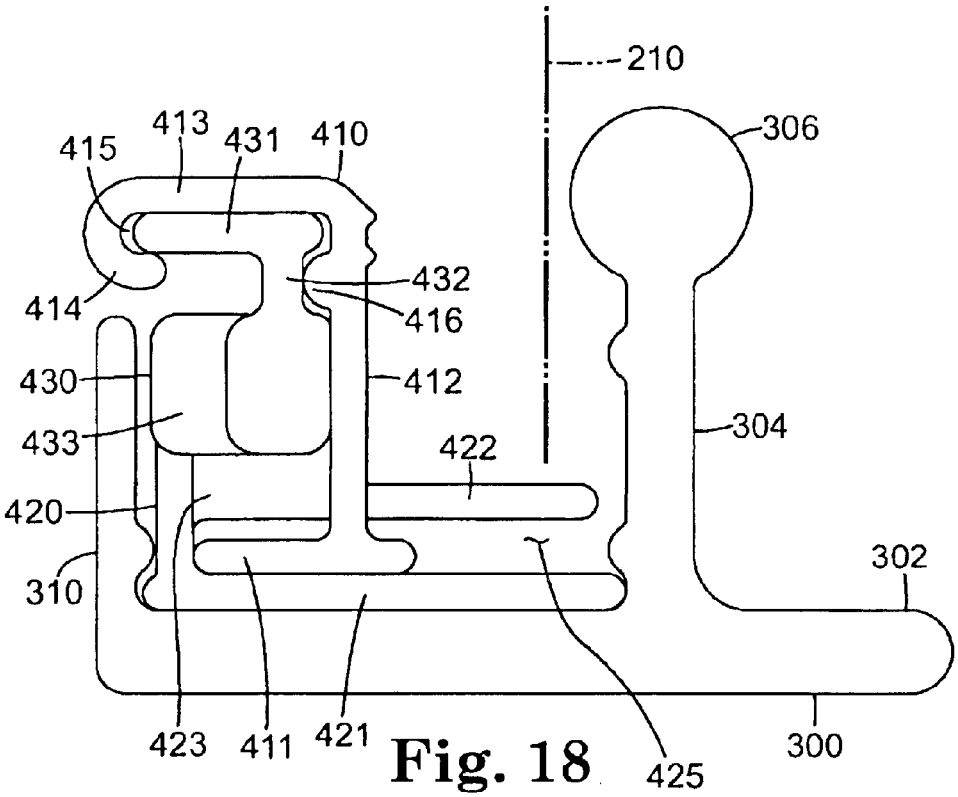
FIG. 18 is an end view of a bottom track including a gripper mechanism, shown with the gripper mechanism in a non-activated position.
Figure 19:
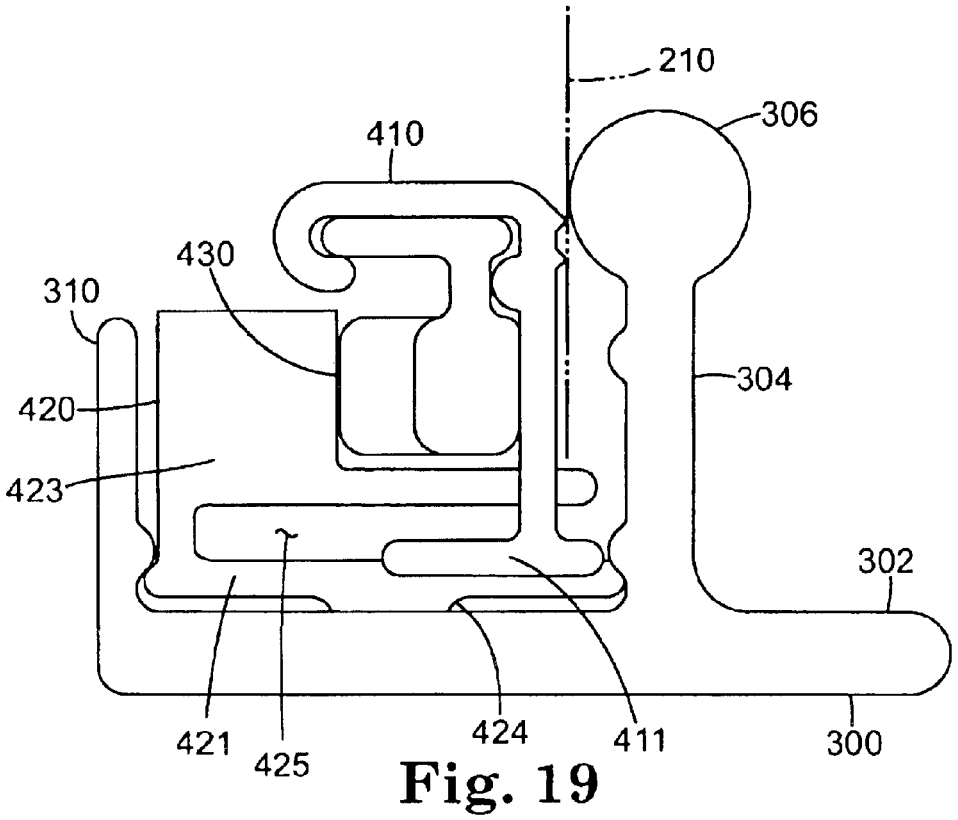
FIG. 19 is an end view of the bottom track of FIG. 18, shown with the gripper mechanism in an activated position.
Figure 20:
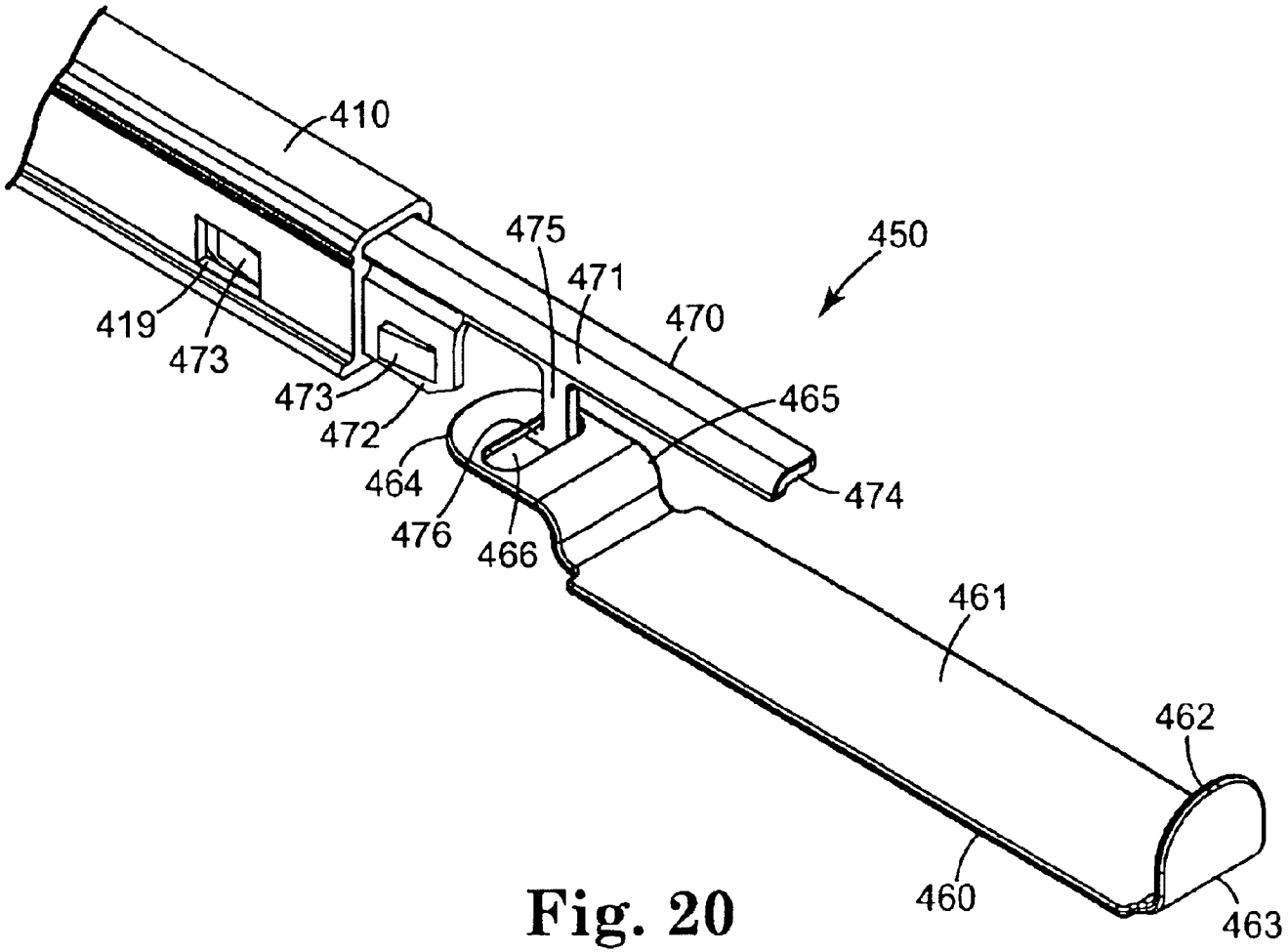
FIG. 20 is a perspective detailed view of a trigger mechanism usable with the gripper mechanism of FIGS. 17–19.
Figure 21:
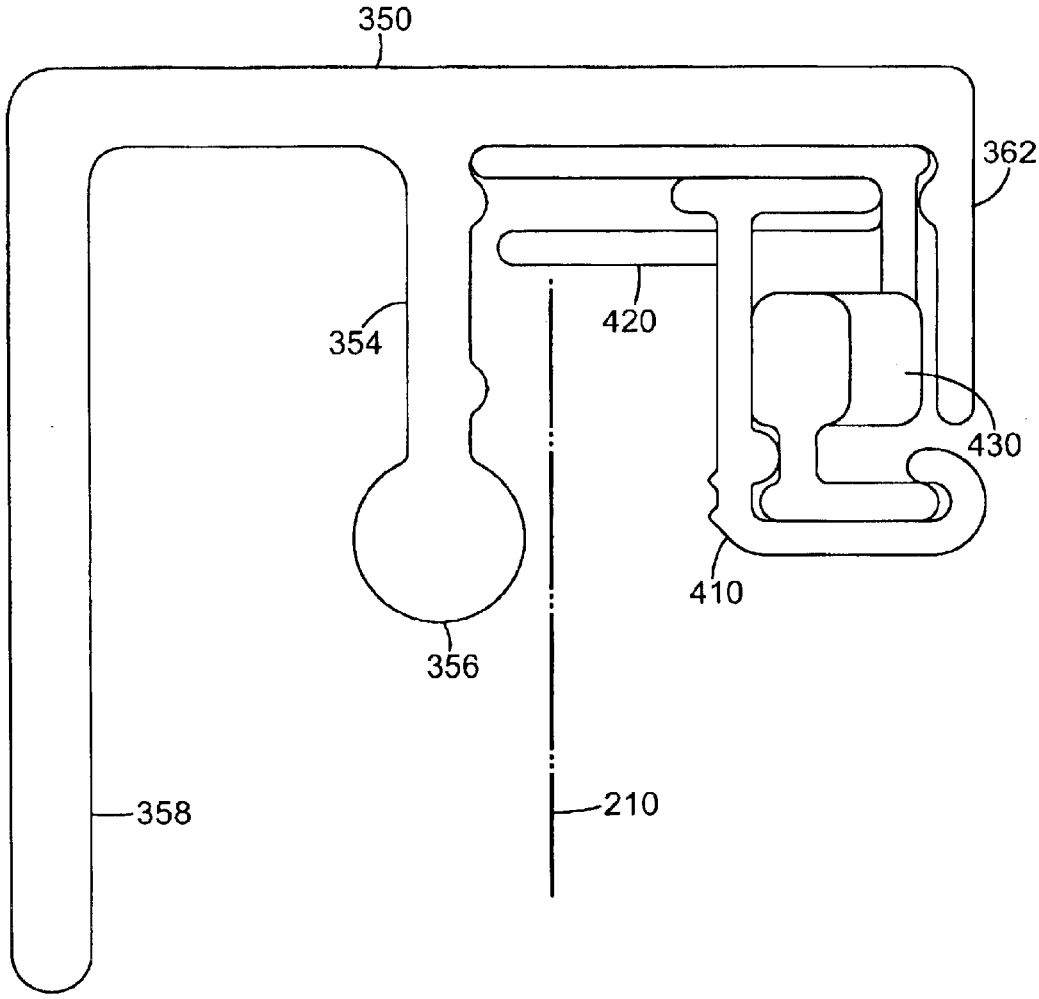
FIG. 21 is an end view of a top track including a gripper mechanism.

When the trigger mechanism 450 is operated during closing of the screen door 200, the gripper bar 410 moves along the length of the track 300 a predetermined distance causing each wedge 430 to slide along the stationary clip 420. The interaction of the curved surface of the wedge base block 433 and the curved surface of the stationary clip block 423 causes the attached gripper bar 410 to move away from the clip 420 and toward the rail 306. Refer to FIGS. 18 and 19, in which the gripper bar 410 is in an non-activated position (FIG. 18) and an activated position (FIG. 19). Upon opening of the screen door 200, the gripper mechanism 400 moves in an opposite manner, such that the wedges 430 move in an opposite direction with respect to the clips 420, causing the gripper bar 410 to move away from the upright rail 306, thereby releasing the flexible screen material 210. The trigger mechanism 450 is not activated during closing until about the last 0.5 inches (about 1.27 centimeters) of travel of the control bar 220 toward the side frame 108, and release of the gripping system 400 occurs in about the first 0.5 inch (about 1.27 centimeters) of control bar 220 movement upon opening of the screen door 200. As stated above, and shown in FIG. 21, the gripping system 400 used with the top track 350 is configured and functions the same as the gripping system 400 described above for the bottom track 300.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. A retractable flexible screen to be installed to a frame of a fenestration product with the flexible screen extending and retracting across an opening in the fenestration product, the frame having first and second pairs of frame members bounding the fenestration product, the flexible screen comprising:

flexible screen material;

a roller system upon which the flexible screen material is unwound and wound during extension and retraction, respectively, the roller system extending across a length of the opening from one of the first pair of frame members to an opposite one of the first pair of frame members with the flexible screen material extending toward one of the second pair of frame members as a closing member;

a pair of mounting brackets, each attachable to one of the first pair of frame members, the roller system mounting to the pair of mounting brackets at each end;

a control bar connected to the flexible screen material at a first edge; and first and second tracks, each mountable to one of the first pair of frame members adjacent to the roller between the roller and the closing member toward which the flexible screen material extends, the first and second tracks each coupled to the control bar at an opposite end, such that the control bar moves back and forth along the first and second tracks from the roller system to the closing member, wherein the control bar further comprises a sill plug interposed between the end of the control bar and one of the first and second tracks, the sill plug moveably engaged with the control bar end and connected to the track so as to move along the track between the roller and the closing member.

2. The flexible screen of claim 1, further comprising a pair of adapters inserted into the ends of the roller and removably coupled to the mounting brackets, such that the roller system is removably mounted to the door frame with a snap-fit.

3. The flexible screen of claim 2, wherein each of the adapters comprises a bayonet connector.

4. The flexible screen of claim 2, wherein the pair of adapters are configured to provide axial adjustment of the roller system's position between the mounting brackets.

5. The flexible screen of claim 1, further comprising a roller cover positioned over the roller and removably coupled to the mounting brackets.

6. The flexible screen of claim 5, wherein the roller cover comprises an outer surface that is adapted to receive stain and paint to correspond with a desired décor of the environment in which the fenestration product is located.

7. The flexible screen of claim 6, wherein the roller cover comprises a veneer outer surface.

8. The flexible screen of claim 5, further comprising a sealing strip positioned between the roller and the fenestration product and removably coupled to the roller cover, the sealing strip providing additional protection from the intrusion of insects and debris through the opening of the fenestration product at the flexible screen.

9. The flexible screen of claim 8, wherein the sealing strip is configured to reduce undesired vibration of the roller during retraction and wind up of the flexible screen material about the roller system.

10. The flexible screen of claim 1, further comprising an anti-vibration system.

11. The flexible screen of claim 1, wherein the flexible screen material comprises a profiled coupling member attached at the leading edge of the flexible screen material, the profiled coupling member facilitating the connection between the flexible screen material and the control bar.

12. The flexible screen of claim 11, wherein the control bar comprises a contoured slot configured to matingly receive the profiled coupling member.

13. The flexible screen of claim 11, wherein the profiled coupling member comprises two mirror image strips attached opposite one another on each surface of the flexible screen material, the two strips configured to together form a generally cylindrical rod having a stem at the edge of the flexible material.

14. The flexible screen of claim 13, wherein the profiled coupling member is ultrasonically welded to the flexible screen material.

15. The flexible screen of claim 1, wherein at least one of the first and second tracks comprises decorated track having an exposed surface adapted to receive stain and paint to correspond with a desired décor of the environment in which the fenestration product is located.

16. The flexible screen of claim 15, further comprising a filler strip adapted to receive stain and paint and positioned adjacent the same one of the first pair of frame members as the decorated track on an opposite side of the roller than the decorated track so as to balance the look of the flexible screen within the frame of the fenestration product.

17. The flexible screen of claim 1, wherein at least one of the first and second tracks comprises an exposed surface covered with veneer.

18. The flexible screen of claim 1, wherein the control bar and sill plug are moveable relative to each other in a longitudinal direction toward and away from the first pair of frame members, the relative movement providing adjustability of the flexible screen so as to accommodate variations in dimension between the first pair of frame members.

19. The flexible screen of claim 1, further comprising a gripping system coupled to the first and second tracks for holding the flexible screen material securely at the first and second tracks when the flexible screen is extended across the door opening in a closed position with the control bar adjacent the closing member.

20. The flexible screen of claim 1, further comprising a gripper mechanism and a triggering mechanism, the gripper mechanism configured to grip the flexible screen material upon activation by the triggering mechanism.

21. The flexible screen of claim 1, further comprising a spring tensioning system external to the roller system for adjusting a spring tension of the roller system.

22. The flexible screen of claim 1, further comprising a spring tensioning system for adjusting a spring tension of the roller, the tensioning system accessible after installation of the flexible screen to the door frame.

23. The flexible screen of claim 1, further comprising an adjustable bracket assembly provided as one of the pair of mounting brackets.

24. The flexible screen of claim 23, wherein the adjustable bracket assembly comprises:

a bracket base configured in a similar manner as the mounting bracket;

a rotatable spring connector coupled to the base and having a connecting post inserted into an end of the roller system and engaged with a spring within the roller system;

a rotatable thumb wheel coupled to the base and the spring connector, the thumb wheel extending out from the base for access by a user; and a cover mounted to the base over the spring connector and thumb wheel so as to retain the spring connector and thumb wheel within the assembly, such that rotation of the thumb wheel by a user results in rotation of the spring connector and connecting post within the roller system causing adjustment of a tension of the roller spring.

25. The flexible screen of claim 1, wherein the roller system comprises a roller to which a second edge of the flexible screen material is attached, a first pair of bonding strips attached to the roller at opposite ends of the roller under the flexible screen material and a second pair of bonding strips attached to the first pair of bonding strips over the flexible screen material, such that the first and second pairs of bonding strips sandwich a portion of the flexible screen material between them.

26. The flexible screen of claim 25, wherein the flexible screen material is wrapped around the roller at least one time before the second pair of bonding strips are attached.

27. A flexible screen to be installed to a frame of a fenestration product, the flexible screen extending and retracting across an opening in the fenestration product, the flexible screen comprising:

flexible screen material configured to extend and retract across the opening;

a roller system upon which the flexible screen material is unwound and wound during extension and retraction, respectively, the roller system mountable to the frame;

a control bar connected to the flexible screen material at a first edge;

a pair of tracks mountable to the frame on opposite ends of the roller system and generally perpendicular to the roller system, each track having a rail, the pair of tracks coupled to the control bar at each rail such that the control bar engages and rides alone each rail as it moves back and forth along the pair of tracks from an open position with the flexible screen material generally retracted to a closed position with the flexible screen material extended across the opening; and a gripping system coupled to the pair of tracks and adapted to hold the flexible screen material securely at the pair of tracks against each rail when the flexible screen is extended across the opening in the closed position, wherein the gripping system comprises a gripper mechanism and a triggering mechanism, the gripper mechanism configured to grip the flexible screen material against each rail upon activation by the triggering mechanism, wherein the gripper mechanism comprises a gripper bar moveable longitudinally along one of the pair of tracks and laterally within the one of the pair of tracks and a clip mounted to the one of the pair of tracks and a wedge mounted to the gripper bar and positioned adjacent the clip, such that longitudinal movement of the gripper bar results in movement of the wedge relative to the clip and contact between the wedge and the clip causing lateral movement of both the wedge and gripper bar.

28. The flexible screen of claim 27, wherein the triggering mechanism is coupled to the opening and closing of the flexible screen, such that activation of the gripper mechanism occurs during the closing of the flexible screen near full extension of the flexible screen material across the opening and release of the gripper mechanism occurs during first opening of the flexible screen from full extension of the flexible screen material across the opening.

29. The flexible screen of claim 27, wherein the gripper mechanism comprises a pair of gripper bars corresponding to the pair of tracks, each gripper bar moveable longitudinally along one track and laterally within that one track, a plurality of clips mounted to each track and a plurality of wedges mounted to each gripper bar and positioned adjacent to one of the plurality of clips, such that longitudinal movement of each gripper bar results in movement of the plurality of wedges relative to the plurality of clips and contact between the plurality of wedges and the plurality of clips causing lateral movement of both the plurality of wedges and the pair of gripper bars.

30. The flexible screen of claim 27, wherein the triggering mechanism comprises an activator coupled to the gripper mechanism and engageable with the control bar, the activator engaging the control bar and thus activating the gripper mechanism near the closed position and disengaging the control bar upon movement from the closed position.

31. The flexible screen of claim 30, wherein the triggering mechanism further comprises an activator plug that connects the activator to the control bar.

32. The flexible screen of claim 31, wherein the activator plug engages the control bar during first opening of the flexible screen to facilitate release of the gripper mechanism.

33. The flexible screen of claim 30, wherein the triggering mechanism comprises a pair of activators corresponding to the pair of tracks, each activator coupled to the gripper mechanism and engageable with the control bar, one at each end of the control bar.

34. A flexible screen to be installed to a frame of a fenestration product, the flexible screen extending and retracting across an opening in the fenestration product, the flexible screen comprising:

flexible screen material configured to extend and retract across the opening;

a roller system upon which the flexible screen material is unwound and wound during extension and retraction, respectively, the roller system mountable to the frame and including an internal spring to facilitate retraction and winding of the flexible screen material;

a control bar connected to the flexible screen material at a first edge;

a pair of tracks mountable to the frame on opposite ends of the roller system and generally perpendicular to the roller system, the pair of tracks coupled to the control bar such that the control bar moves back and forth along the pair of tracks from an open position with the flexible screen material fully retracted to a closed position with the flexible screen material extended across the opening; and a spring tensioning system for adjusting a spring tension of the roller spring, the tensioning system external to the roller system, wherein the roller system mounts to the frame by a pair of mounting brackets, and wherein the tensioning system comprises an adjustable bracket assembly provided as one of the pair of mounting brackets, wherein the adjustable bracket assembly comprises:

a bracket base configured in a similar manner as the mounting bracket;

a rotatable spring connector coupled to the base and having a connecting post inserted into an end of the roller and engaged with a spring within the roller;

a rotatable thumb wheel coupled to the base and the spring connector, such that rotation of the thumb wheel results in rotation of the spring connector and connecting post within the roller causing adjustment of a tension of the roller spring; and a cover mounted to the base over the spring connector and thumb wheel so as to retain the spring connector and thumb wheel within the assembly.

35. The flexible screen of claim 34, wherein the spring tensioning system is accessible after installation of the flexible screen to the frame.

36. A retractable flexible screen to be installed to a frame of a fenestration product with the flexible screen extending and retracting across an opening in the fenestration product, the frame having first and second pairs of frame members bounding the fenestration product, the flexible screen comprising:

flexible screen material;

a roller system upon which the flexible screen material is unwound and wound during extension and retraction, respectively, the roller system extending across a length of the opening from one of the first pair of frame members to an opposite one of the first pair of frame members with the flexible screen material extending toward one of the second pair of frame members as a closing member;

a pair of mounting brackets, each attachable to one of the first pair of frame members, the roller system mounting to the pair of mounting brackets at each end;

a control bar connected to the flexible screen material at a first edge; and first and second tracks, each mountable to one of the first pair of frame members adjacent to the roller between the roller and the closing member toward which the flexible screen material extends, the first and second tracks each coupled to the control bar at an opposite end, such that the control bar moves back and forth along the first and second tracks from the roller system to the closing member, wherein the flexible screen material comprises a profiled coupling member attached at the leading edge of the flexible screen material, the profiled coupling member facilitating the connection between the flexible screen material and the control bar, wherein the profiled coupling member comprises two mirror image strips attached opposite one another on each surface of the flexible screen material, the two strips configured to together form a generally cylindrical rod having a stem at the edge of the flexible material.

37. The flexible screen of claim 36, wherein the profiled coupling member is ultrasonically welded to the flexible screen material.

38. A retractable flexible screen to be installed to a frame of a fenestration product with the flexible screen extending and retracting across an opening in the fenestration product, the frame having first and second pairs of frame members bounding the fenestration product, the flexible screen comprising:

flexible screen material;

a roller system upon which the flexible screen material is unwound and wound during extension and retraction, respectively, the roller system extending across a length of the opening from one of the first pair of frame members to an opposite one of the first pair of frame members with the flexible screen material extending toward one of the second pair of frame members as a closing member;

a pair of mounting brackets, each attachable to one of the first pair of frame members, the roller system mounting to the pair of mounting brackets at each end;

a control bar connected to the flexible screen material at a first edge;

first and second tracks, each mountable to one of the first pair of frame members adjacent to the roller between the roller and the closing member toward which the flexible screen material extends, the first and second tracks each coupled to the control bar at an opposite end, such that the control bar moves back and forth along the first and second tracks from the roller system to the closing member; and an adjustable bracket assembly provided as one of the pair of mounting brackets, wherein the adjustable bracket assembly comprises:

a bracket base configured in a similar manner as the mounting bracket;

a rotatable spring connector coupled to the base and having a connecting post inserted into an end of the roller system and engaged with a spring within the roller system;

a rotatable thumb wheel coupled to the base and the spring connector, the thumb wheel extending out from the base for access by a user; and a cover mounted to the base over the spring connector and thumb wheel so as to retain the spring connector and thumb wheel within the assembly, such that rotation of the thumb wheel by a user results in rotation of the spring connector and connecting post within the roller system causing adjustment of a tension of the roller spring.

39. A retractable flexible screen to be installed to a frame of a fenestration product with the flexible screen extending and retracting across an opening in the fenestration product, the frame having first and second pairs of frame members bounding the fenestration product, the flexible screen comprising:

flexible screen material;

a roller system upon which the flexible screen material is unwound and wound during extension and retraction, respectively, the roller system extending across a length of the opening from one of the first pair of frame members to an opposite one of the first pair of frame members with the flexible screen material extending toward one of the second pair of frame members as a closing member;

a pair of mounting brackets, each attachable to one of the first pair of frame members, the roller system mounting to the pair of mounting brackets at each end;

a control bar connected to the flexible screen material at a first edge;

first and second tracks, each mountable to one of the first pair of frame members adjacent to the roller between the roller and the closing member toward which the flexible screen material extends, the first and second tracks each coupled to the control bar at an opposite end, such that the control bar moves back and forth along the first and second tracks from the roller system to the closing member, wherein the control bar further comprises a sill plug interposed between the end of the control bar and one of the first and second tracks, the sill plug continuously moveably engaged with the control bar end and coupled to the track so as to move along the track between the roller and the closing member to provide non-binding movement of the control bar along the first and second tracks.

40. The flexible screen of claim 39, wherein the control bar and sill plug are moveable relative to each other in a longitudinal direction toward and away from the first pair of frame members, the relative movement providing adjustability of the flexible screen as the screen extends and retracts so as to accommodate variations in dimension between the first pair of frame members.

* * * * *